US005996374A

United States Patent [19]

Bardisbanyan

[11] Patent Number: 5,996,374

[45] Date of Patent: Dec. 7, 1999

[54] JEWELRY RING INCLUDING ROTATABLE ELEMENT

[75] Inventor: Vahram Bardisbanyan, Los Angeles County, Calif.

[73] Assignee: Marquesa Jewelry Co., Inc., Van Nuys, Calif.

[21] Appl. No.: 09/090,143

[22] Filed: Jun. 4, 1998

[51] Int. Cl.[6] ..... A44C 9/00

[52] U.S. Cl. ..... 63/15; 63/15.7; 63/26; 63/29.1; 63/31; 63/40

[58] Field of Search ..... 63/12, 13, 15, 63/15.7, 15.8, 26, 29.1, 31, 40

[56] References Cited

U.S. PATENT DOCUMENTS

| | | | |
|---|---|---|---|
| D. 115,930 | 8/1939 | Kronstadt | 63/15 X |
| D. 115,931 | 8/1939 | Kronstadt | 63/15 X |
| 122,328 | 1/1872 | Northup | 63/13 |
| 241,462 | 5/1881 | Washburn | 63/13 |
| 501,365 | 7/1893 | Rohde | 63/29.1 |
| 983,598 | 2/1911 | Auerbach | 63/12 |
| 1,182,534 | 5/1916 | Driggott | 63/29.1 |
| 1,195,244 | 8/1916 | Lidzbarsky | 63/15 |
| 1,712,171 | 5/1929 | Rochas | 63/29.1 |
| 1,920,875 | 8/1933 | Miskend | 63/15 |
| 1,971,265 | 8/1934 | King | 63/29.1 X |
| 2,430,508 | 11/1947 | Holl | 63/15 |
| 2,545,219 | 3/1951 | Wittmayer | 63/15 X |
| 2,666,305 | 1/1954 | Wittmayer | 63/31 X |
| 4,080,803 | 3/1978 | Suzuki | 63/31 X |
| 4,220,017 | 9/1980 | Freeman | 63/15 |
| 4,726,200 | 2/1988 | Carter | 63/31 X |
| 4,794,766 | 1/1989 | Schunk et al. | 63/29.1 X |
| 5,375,434 | 12/1994 | Wertheimer et al. | 63/29.1 |

FOREIGN PATENT DOCUMENTS

| | | | |
|---|---|---|---|
| 2693880 | 1/1994 | France | 63/15 |
| 253315 | 11/1948 | Switzerland | 63/29.1 |

*Primary Examiner*—Terry Lee Melius
*Assistant Examiner*—Andrea Chop
*Attorney, Agent, or Firm*—Levisohn, Lerner, Berger & Langsam

[57] ABSTRACT

A jewelry ring which comprises a ring section and a rod support section located above the ring section in which the rod support section includes rod support members at least one of which is hingedly connected to the ring section permitting the rod support members to be moved away from engaging the rod allowing a rotatable element to be inserted, placed on or removed from the rod and to lock the rotatable element in place when the movable support is moved into engagement with the rod.

19 Claims, 2 Drawing Sheets

JEWELRY RING INCLUDING ROTATABLE ELEMENT

BACKGROUND OF THE INVENTION

This invention relates to a novelty jewelry item, and more particularly to a jewelry item which may be made of precious metal.

The ability to provide jewelry with movable parts has become increasingly important in the current marketing environment. Items which are displayed on television which have movable parts sell relatively well. Additionally, such items have always been attractive to the jewelry customer.

U.S. Pat. No. 1,920,875 to H. L. Miskend was issued on Aug. 1, 1933. It shows a jewelry ring having a pin 21 carried between apertures 20 in upper side walls of ring 16. The pin 21 is secured as by threading or the like with an element 18 or, the element 18 may be fixedly connected so as to maintain pin 21 permanently in place allowing a ball 11 to rotate thereon. The Miskend patent fails to show, suggest or disclose an easy method to remove the ball from the pin and also fails to show, suggest or disclose maintaining a physical connection between any of the connecting elements for such attachment of the ball and the ring structure itself.

U.S. Pat. No. 4,977,757 entitled "Jewelry With Rotatable Ornamentation" issued to Zuri Mesica, et al. also discloses a jewelry ring with a rotatable upper section comprised of a plurality of cylindric al elements 30–38 connected through an elongated sleeve 22 having internal threading and adapted to receive a screw 24. In order for the rotatable elements to be removed from sleeve 22, members 22 an 24 are separated allowing the individual rotating cylinders to be removed. Any of the separated elements may easily be lost, Further, threading the sleeve 22 and screw through apertures 18 and 20 in the appropriate fashion to secure rotatable members 30–38 in place may require some finger dexterity beyond the ordinary person.

An object of this invention is to provide a ring with an upper pin support section upon which a rotatable decorative jewelry component may be carried and easily moved.

Another object of this invention is to provide a simple and effective mechanism permitting the decorative jewelry component to be easily removed or replaced onto the support pin without losing components of the attachment mechanism.

Yet another object of this invention is to provide such a jewelry structure which is attractive, easily manufactured and susceptible to widespread use.

Other objects, advantages and features of this invention will become more apparent from the following description.

SUMMARY OF THE INVENTION

In accordance with the principles of this invention, the above objects are accomplished by providing a ring having a ring section with a pin support section located on top of the ring section. The pin support section comprises a pin fixedly attached to one support member, while the opposite pin support member is hingedly connected to the structure of the ring and may easily be flipped open allowing access to the pin to replace the ball or remove the ball therefrom. The movable pin support member is hingedly and fixedly connected to the ring section so that when the movable pin support structure is moved away from connection with the pin carrying the rotatable decorative jewelry component, the pin support structure is not separated from the ring and is therefore, not able to be misplaced. Further, the movable and hingeable pin support is merely simply flipped downwardly or upwardly with a simple manual movement, and in the upward position, simply catches into a notch in the pin allowing a secure engagement between the pin and the pin support structure. The rotatable jewelry element has a through hole therein of sufficient size to permit the decorative element to be worn on a chain much as a decorative pendant or necklace.

DETAILED DESCRIPTION

Figure 1:
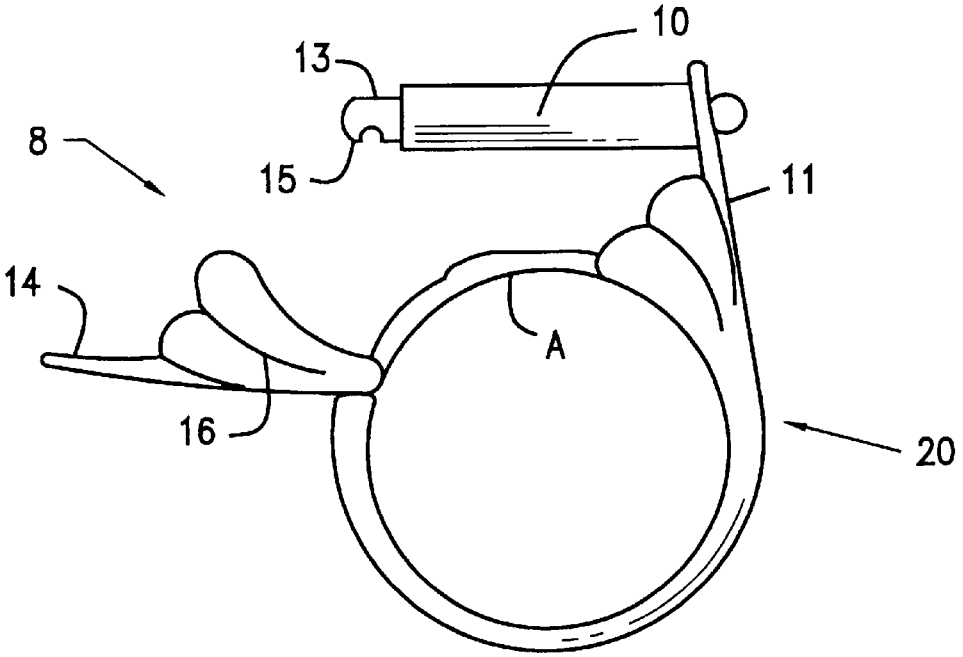
FIG. 1 is an end view of the structure of the ring of this invention.

FIG. 1 is an end view of the ring 8 having a rod 10 fixedly connected at one side to a support member 11 and having a free end 13 having a notch 15 therein which engages with an aperture 14 in opposite hingedly and movable connected support member 16 which is hingedly connected to the ring structure as at 20.

Figure 2:
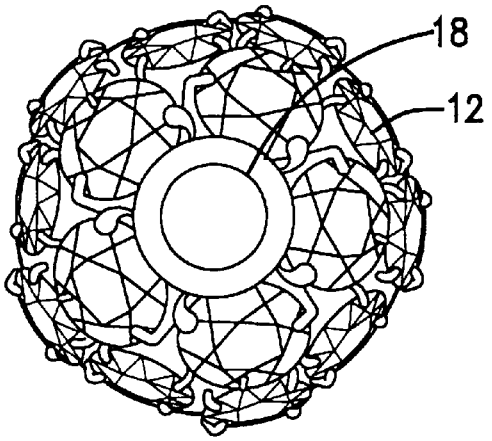
FIG. 2 is an end view of the decorative element carried by the pin structure of this invention.
Figure 3:
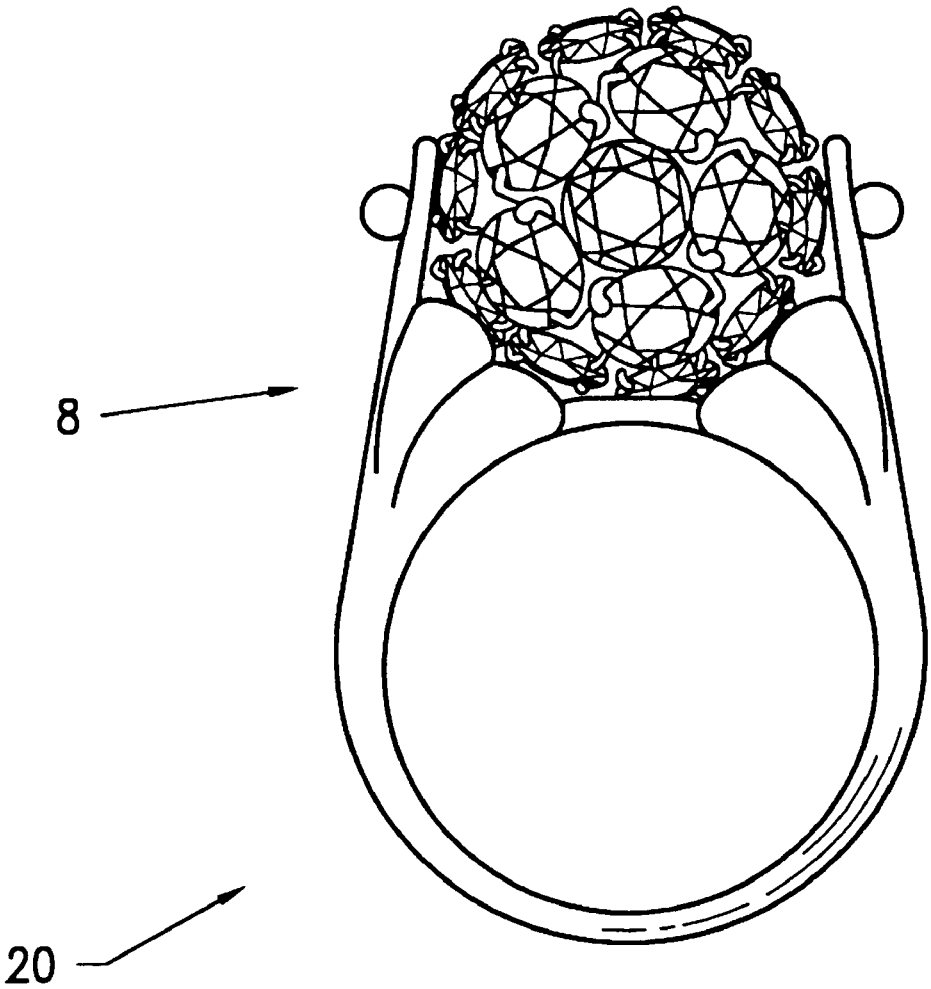
FIG. 3 is an end view showing the decorative element of the jewelry item of this invention fixedly connected in place by moving the hinged support into engagement with the pin.

FIG. 2 is an end view of the decorative component of this invention having a through aperture 18 in a decorative component 12 of a generally round ball construction with the through aperture 18 large enough to slide on rod 10 of FIG. 1. The size of aperture 18 permits its free rotation on rod 10 so that a freely rotatable ball 18 is carried on the ring 8 to be an attractive jewelry item for the ordinary wearer.

The movable support member 16 is hingedly connected to the ring section as described above so as to enable the support member 16 to merely flip down or be pushed upwardly as desired. When flipped down, aperture 14 disengages from notch 15 in rod 10 allowing the ball to either be removed or placed thereon, and when the hingedly connected support member is pushed onto rod 10, 14 of the support member engages notch 15 of rod 10 thereby fixedly connecting the round ball in place. The rod is fixedly connected to opposite support member 11, and the opposite support member 11 is integrally formed when ring 8 is formed.

The hinged support member 16 is separately made and connected to the ring at 20.

The rod support members are illustrated as fluted wall segments but any suitable decorative style may be employed. The fluted wall segments provide an attractive means to cover over the area of the hinged connection between the ring section and the support members. This invention has been described with reference to a preferred embodiment. Other modifications may be made to the structure of this invention without departing from the spirit and scope of the invention as set forth in the pending claims.

What is claimed is:

1. A jewelry item comprising a jewelry ring having a round ring section and a rod support section located above the round ring section, said rod support section comprising a rod supported between opposite rod support members, at least one of said rod support members being movable and hingedly connected to said round ring section so as to maintain a permanent physical connection between said movable rod support member and said jewelry ring, said movable rod support member being movable away from said rod, and a decorative jewelry component comprising a hole therethrough, said jewelry component carried on said rod, said rod passing through said hole and carrying said jewelry component.

2. A jewelry item according to claim 1, wherein said rod is fixedly connected to one of said rod support members.

3. A jewelry item according to claim 2, wherein the other one of said opposite rod support members is fixedly attached to said round ring section.

4. A jewelry item according to claim 3, wherein said other one of said opposite rod support members is integrally formed with said round ring section.

5. A jewelry item according to claim 3, wherein said decorative jewelry component is rotatable about said rod.

6. A jewelry item according to claim 1, wherein the other one of said opposite rod support members is fixedly attached to said round ring section.

7. A jewelry item according to claim 6, wherein said decorative jewelry component is rotatable about said rod.

8. A jewelry item according to claim 7, wherein said decorative jewelry component comprises a ball member.

9. A jewelry item according to claim 1, wherein said other one of said opposite rod support members is integrally formed with said round ring section.

10. A jewelry item according to claim 1, wherein said hole through said jewelry component is of a size sufficient to allow a jewelry chain to pass therethrough allowing said decorative jewelry component to be worn as a pendant.

11. A jewelry item according to claim 10, wherein said decorative jewelry component is rotatable about said rod.

12. A jewelry item according to claim 1, wherein each of said rod support members comprise substantially similar design elements.

13. A jewelry item according to claim 12, wherein each of said rod support members comprise fluted wall segments.

14. A jewelry item according to claim 12, wherein said rod is fixed to one of said rod support members, said movable rod support member comprising an aperture into which said rod is fixedly held when said rod support section is assembled.

15. A jewelry item according to claim 14, wherein said rod contains a notch to fixedly connect with said aperture of said movable rod support member.

16. A jewelry item according to claim 1, wherein said rod is longer than the length of said jewelry component, wherein the entirety of said jewelry component is carried on said rod.

17. A jewelry item according to claim 16, wherein said rod is fixedly connected to one of said rod support members.

18. A jewelry item according to claim 16, wherein the other one of said opposite rod support members is fixedly attached to said round ring section.

19. A jewelry item according to claim 16, wherein said other one of said opposite rod support members is integrally formed with said round ring section.

* * * * *